US008696090B2

(12) United States Patent
Xiao

(10) Patent No.: US 8,696,090 B2
(45) **Date of Patent: *Apr. 15, 2014**

(54) ADAPTER ON JET PRINTER AND ITS CORRESPONDING INK CARTRIDGE

(75) Inventor: Biao Xiao, Zhuhai (CN)

(73) Assignee: Zhuhai Ninestar Management Co., Ltd., Zhuhai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,991

(22) Filed: Nov. 11, 2011

(65) Prior Publication Data

US 2012/0056939 A1 Mar. 8, 2012

Related U.S. Application Data

(63) Continuation of application No. PCT/CN2010/072734, filed on May 13, 2010.

(30) Foreign Application Priority Data

May 13, 2009 (CN) ..... 2009 1 0039523

(51) Int. Cl.
*B41J 2/14* (2006.01)
*B41J 2/16* (2006.01)

(52) U.S. Cl.
USPC ..... 347/50

(58) Field of Classification Search
USPC ..... 347/50
See application file for complete search history.

(56) References Cited

U.S. PATENT DOCUMENTS

| | | | | |
|---|---|---|---|---|
| 5,488,395 A | 1/1996 | Takayanagi et al. | ..... | 347/7 |
| 5,860,363 A | 1/1999 | Childers et al. | ..... | 101/483 |
| 6,398,335 B1 * | 6/2002 | Benjamin | ..... | 347/19 |
| 2005/0212877 A1 | 9/2005 | Liang | ..... | 347/86 |
| 2009/0051746 A1 * | 2/2009 | Asauchi | ..... | 347/86 |

FOREIGN PATENT DOCUMENTS

| | | | |
|---|---|---|---|
| CN | 1310095 | A | 8/2001 |
| CN | 201161472 | Y | 12/2008 |
| CN | 101518991 | A | 9/2009 |
| CN | 201419542 | Y | 3/2010 |
| CN | 201456561 | U | 5/2010 |
| CN | 201511595 | U | 6/2010 |

(Continued)

OTHER PUBLICATIONS

International Search Report of international PCT application No. PCT/CN2010/072734, issued on Aug. 12, 2010.

*Primary Examiner* — Matthew Luu
*Assistant Examiner* — Renee I Wilson
(74) *Attorney, Agent, or Firm* — J.C. Patents

(57) ABSTRACT

The present invention relates to an adapter on jet printer and its corresponding ink cartridge. The adapter comprises a chamber for accommodating the ink cartridge and a chip set on the adapter. The contact surface of the chip and the printer is set with an information contact that is electrically connected with the printer and two detecting contacts. The opposite back surface of the chip with two detecting contacts is set with a non-contact trigger switch. The non-contact trigger switch is electrically connected with two detection contacts respectively. The non-contact trigger switch is triggered to become disconnected at least once by the non-contact trigger mechanism on the ink cartridge when the ink cartridge is inserted into the printer, after which it is not triggered by the non-contact trigger mechanism so as to go to the connected status.

16 Claims, 9 Drawing Sheets

(56) References Cited

FOREIGN PATENT DOCUMENTS

| | | | |
|---|---|---|---|
| CN | 101885270 | B | 9/2012 |
| DE | 199 17 229 | A1 | 10/2000 |
| JP | 03-227650 | | 10/1991 |
| JP | 06-320732 | | 11/1994 |
| JP | 2001-187456 | A | 7/2001 |
| JP | 2002-120379 | A | 4/2002 |
| JP | 2004-306498 | A | 11/2004 |

* cited by examiner

ADAPTER ON JET PRINTER AND ITS CORRESPONDING INK CARTRIDGE

CROSS-REFERENCE TO RELATED APPLICATIONS

This application is a continuation of International Application No. PCT/CN2010/072734, filed on May 13, 2010, which claims the priority benefit of China Patent Application No. 200910039523.6, filed on May 13, 2009. The contents of the above identified applications are incorporated herein by reference in their entirety.

FIELD OF THE TECHNOLOGY

The invention relates to an adapter on jet printer and corresponding ink cartridge.

BACKGROUND

In some existing series or models of printers, some users use the corresponding adapter and ink cartridge of the jet printer, whose structure mainly consists of an ink chamber for accommodating the ink, an ink outlet for supplying ink to the printing head, an air inlet section, a valve structure for keeping the ink chamber stable negative pressure, a chip for sending ink cartridge information to the printer and an printer adapter for positioning the chip (as shown in FIG. 1, which shows the diagram of the existing printer adapter and ink cartridge). It works in such a manner: First, install the adapter 2 that comprises a chip 1 containing the ink information into the printer. After the adapter 2 is installed into the printer, all contacts on the chip 1 fit closely with those on the printer. Then, install the ink cartridge 5 into the adapter 2 with the ink supply needle inserted into the ink outlet of the ink cartridge 5. The printer starts working normally. After the ink is run out, the printer promotes to change the ink cartridge 5. Take out the ink cartridge 5, and change a new one. After rereading the ink information, the printer continues working.

While the printer is working, all contacts on the chip 1 and those on the printer constitute a connected circuit. The printer can detect the ink level information on the chip 1. When changing the ink cartridge, the circuit mentioned above must be disconnected. Upon detecting the circuit has been disconnected, the printer can know the change action of the ink cartridge and erase the ink level information saved on the printer, so as to obtain the ink level information of the new ink cartridge. Otherwise, if the circuit is not disconnected, the printer would not erase the stored ink level information, which would make the information not identical with that of the new ink cartridge saved on the chip. The printer will generate an error message of printing failure.

However, the problem existing in the prior art is that, if the adapter is not taken out while changing the ink cartridge, the circuit connecting the chip and the printer will keep in the connected status and can't be disconnected automatically, which would result in an error message of printing failure generated on the printer. Therefore, some series of printers now have a set of programs, which makes the chip not reset unless detached with the printer. Namely, when changing the ink cartridge, the user using the adapter must take out both the ink cartridge and the adapter to make the said circuit disconnected. After the ink cartridge is reinstalled, the replacement purpose is achieved. This increases the adapter disassembly and assembly process, reduces the service life of the adapter and increases the workload and cost of the user.

SUMMARY

The present invention provides an adapter on jet printer and its corresponding ink cartridge to solve the existing technical problem that the adapter must be taken out from the printer when reinstalling the ink cartridge into the adapter.

In order to solve the foresaid technical problem, the present invention adopts the following technical solution:

An adapter on jet printer, comprising an inner chamber for accommodating the ink cartridge and a chip set on the adapter, wherein the contact surface of the said chip and the printer is set with an information contact that is electrically connected with the printer and two memories that detect the electrical contact and store the ink information; the said chip is set with a non-contact trigger switch; the said non-contact trigger switch is electrically connected with two detecting contacts respectively; the said non-contact trigger switch is triggered to become disconnected at least once by the non-contact trigger mechanism on the ink cartridge when the ink cartridge is inserted into the printer, after which it is not triggered by the non-contact trigger mechanism so as to go to the connected status.

According to the present invention, the said chip is set on the surface of the side wall where the adapter and the printing head have their corresponding contacts jointed.

According to the present invention, the said non-contact trigger switch is set on the opposite back surface or the same surface of two detecting contacts of the said chip.

According to the present invention, the said non-contact trigger switch is connected and disconnected by controlling the magnetic field force between the said non-contact trigger switch and the non-contact trigger mechanism.

According to the present invention, the said non-contact trigger switch is a reed switch.

According to the present invention, the said non-contact trigger switch is a normally closed magnetic switch, which has the magnet or ferromagnetic substance that generates magnetic force with the non-contact trigger mechanism.

According to the present invention, the magnetic flux of the magnet on the said non-contact trigger switch is 500~1500 gauss.

An ink cartridge corresponding to the adapter of the present invention, wherein the said ink cartridge is set with a non-contact trigger mechanism that matches the non-contact trigger switch of the chip.

According to the ink cartridge of the present invention, the said non-contact trigger mechanism is a magnet that can generate magnetic action with the non-contact trigger switch.

According to the ink cartridge of the present invention, the said non-contact trigger mechanism is the ferromagnetic substance that can generate magnetic action with the non-contact trigger switch.

According to the ink cartridge of the present invention, the magnetic flux of the magnet on the said non-contact trigger mechanism is 1000~5000 gauss.

According to the ink cartridge of the present invention, the said non-contact trigger mechanism is embedded in the ink cartridge of the side wall corresponding to the non-contact trigger switch of the adapter chip, the trigger travel path of the said non-contact trigger mechanism passes through the trigger area of the non-contact trigger switch.

According to the ink cartridge of the present invention, the said non-contact trigger mechanism is set on the side wall of the ink cartridge in a fixed manner and the trigger travel path of the said non-contact trigger mechanism passes through the trigger area of the non-contact trigger switch.

According to the ink cartridge of the present invention, the said non-contact trigger mechanism is set on the side wall of the ink cartridge in a movable manner and the trigger travel path of the said non-contact trigger mechanism passes through the trigger area of the non-contact trigger switch.

According to the ink cartridge of the present invention, the trigger travel path of the said non-contact trigger mechanism passes through the trigger area of the non-contact trigger switch. The effective distance between the non-contact trigger mechanism and the non-contact trigger switch in the trigger area is 3~10 mm.

After the foresaid technical solution is adopted, the said non-contact trigger switch is triggered to become disconnected at least once by the non-contact trigger mechanism on the ink cartridge when the ink cartridge is inserted into the printer, after which it is not triggered by the non-contact trigger mechanism so as to go to the connected status. Therefore, when the ink cartridge is inserted into the printer adapter, it is disconnected at least once. After the insertion, the chip is connected with the printer. When the ink cartridge is taken out from the printer adapter which is not taken out from the printer, the chip is disconnected from the printer. This solves the existing technical problem that the adapter must be taken out from the printer when reinstalling the ink cartridge into the adapter.

All symbols in the figures have the following meanings: 1—chip; 2—adapter; 3—magnetic switch; 4—non-contact trigger mechanism; 5—ink cartridge; 31—contact connected with the detecting contact; 32—stop stud; 33—magnet.

DETAILED DESCRIPTION

The embodiment of the present invention first provides a chip, whose main improvement lies in that a non-contact trigger switch is added, which can be electrically connected with two detecting contacts on the chip respectively, wherein the said non-contact trigger switch is triggered to be disconnected at least once by the non-contact trigger mechanism on the ink cartridge when the ink cartridge is inserted into the printer, after which it is not triggered by the non-contact trigger mechanism so as to go to the connected status, making the chip and the printer disconnected and connected automatically.

Embodiment 1

Figure 1:
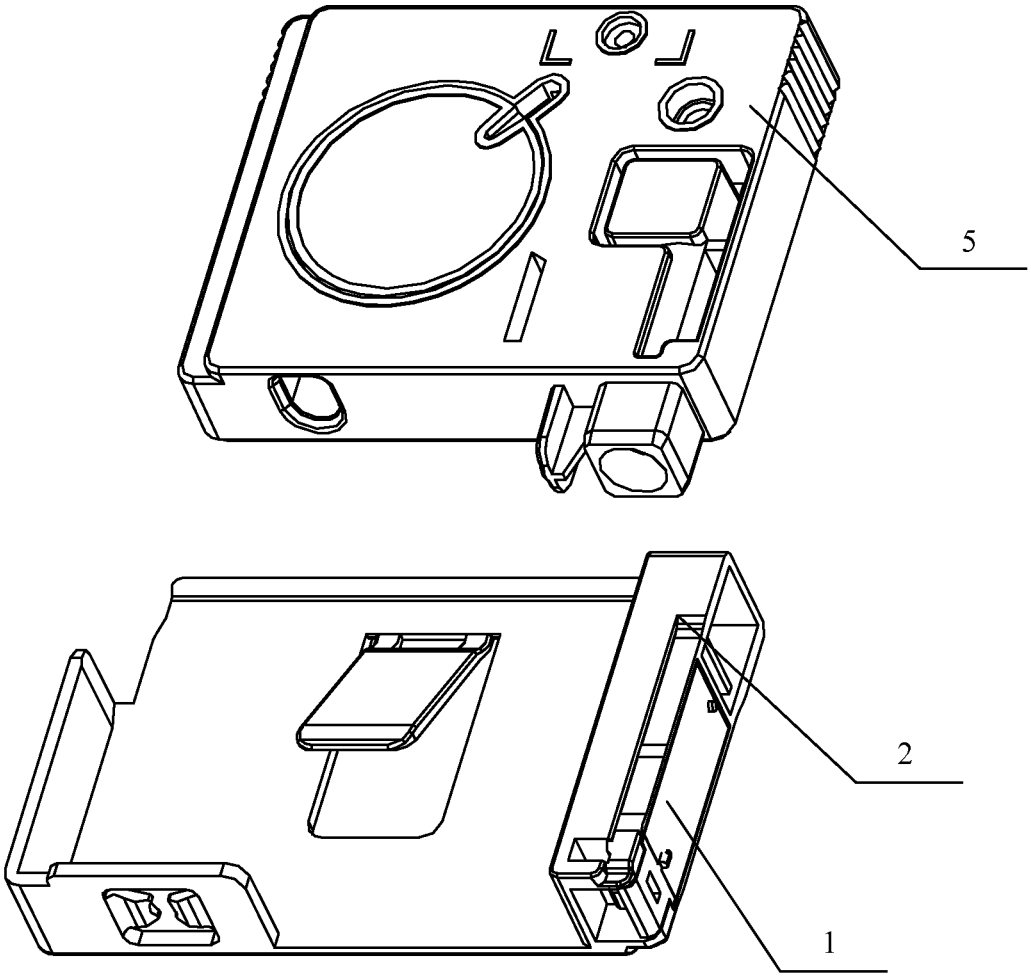
FIG. 1 is the diagram of the existing printer adapter and ink cartridge.
Figure 2:
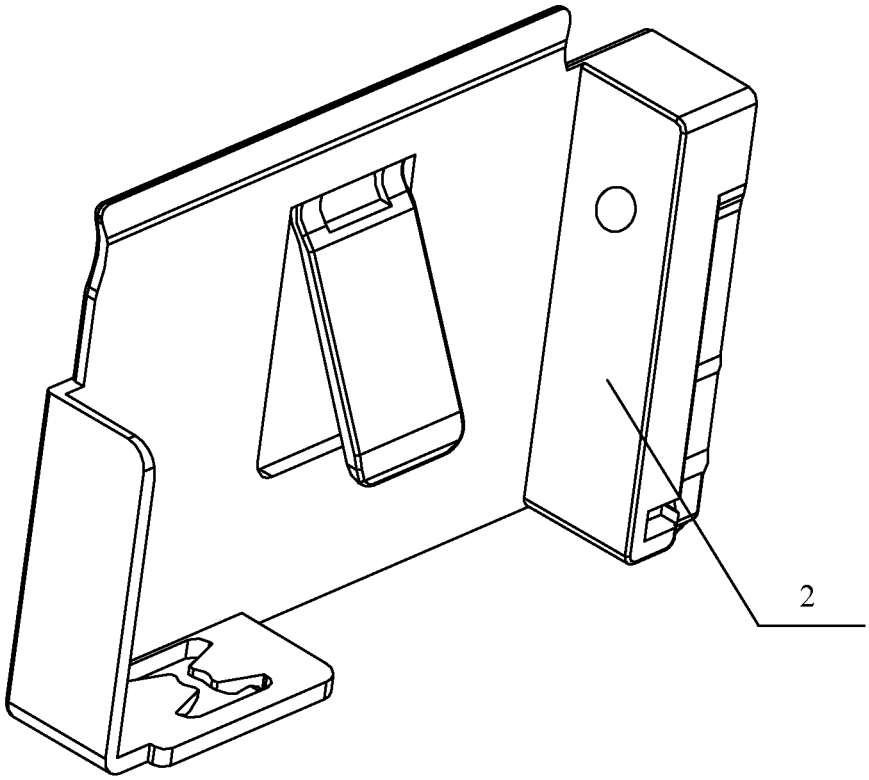
FIG. 2 is the diagram of the printer adapter in the present invention.
Figure 3:
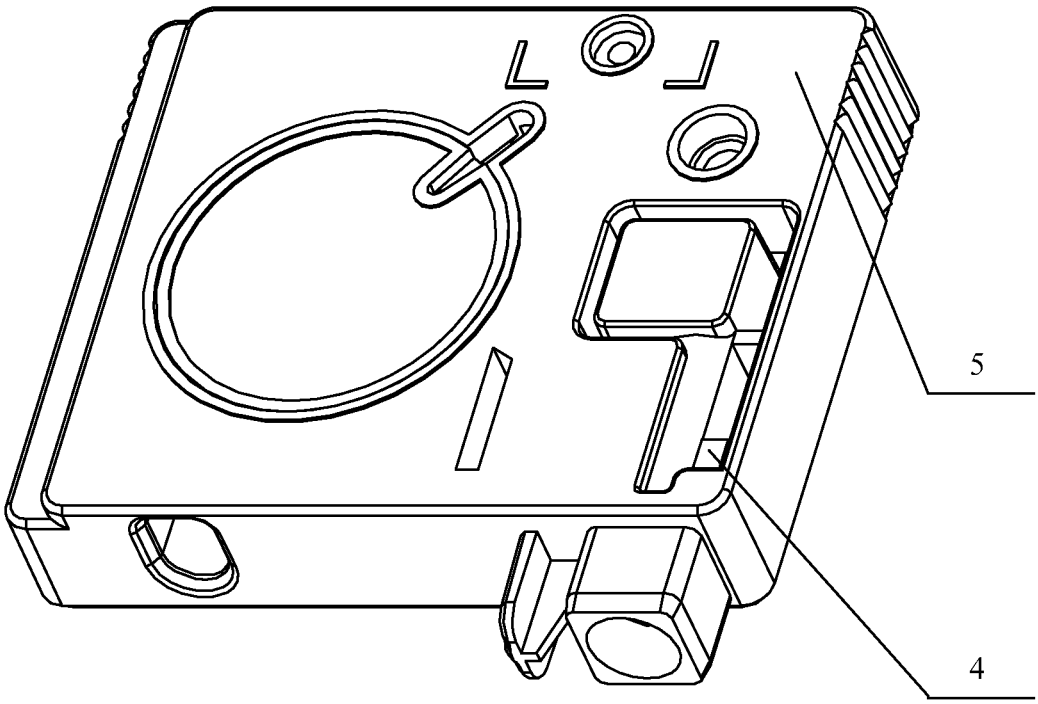
FIG. 3 is the diagram of the ink cartridge in the present invention.
Figure 4:
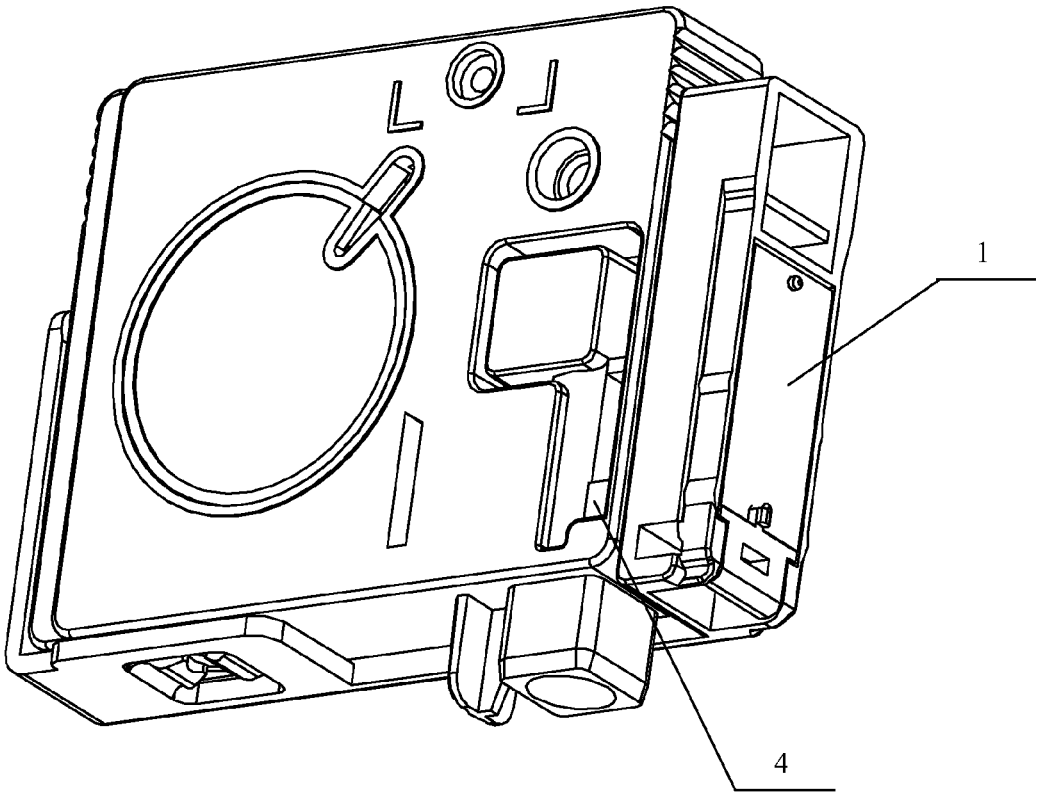
FIG. 4 is the conjunction structure diagram of the adapter and ink cartridge in the present invention.
Figure 5:
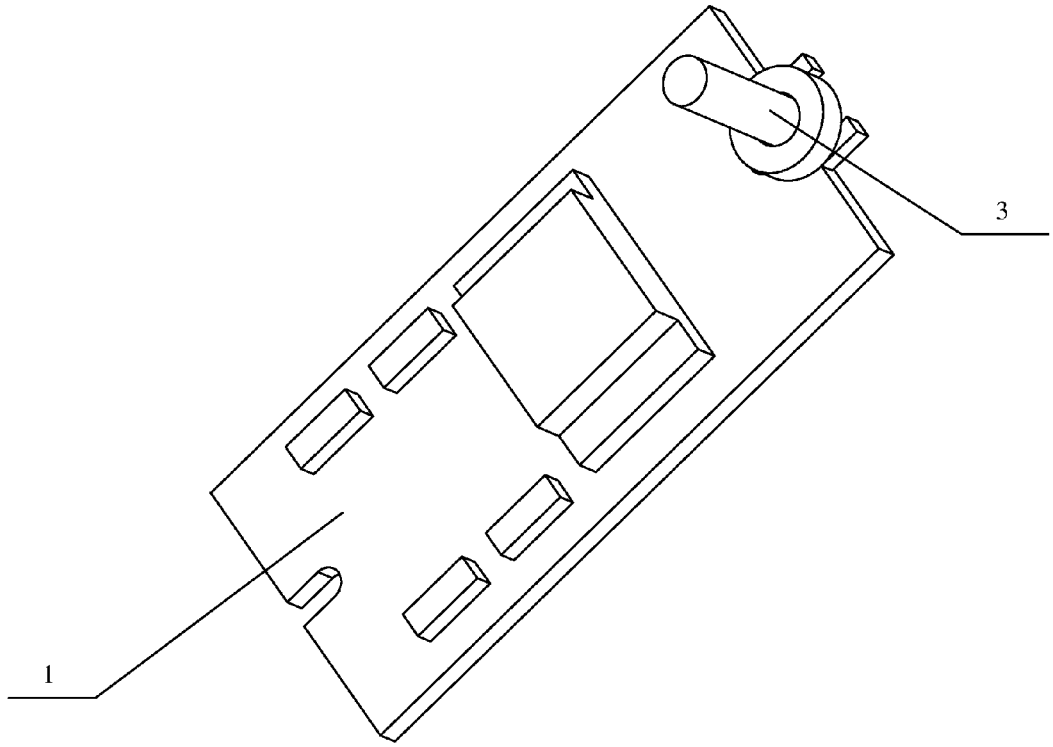
FIG. 5 is the shape diagram of the chip in the present invention.
Figure 6:
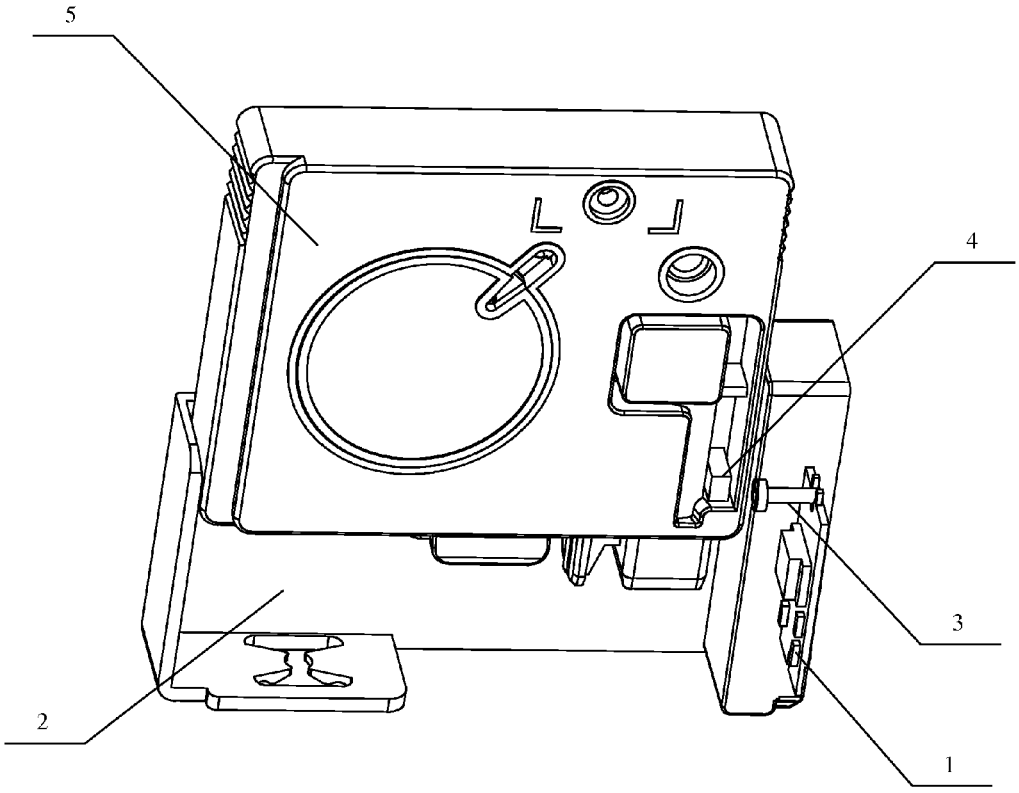
FIG. 6 is the diagram of the relative position between the ink cartridge and the chip during the assembly process with the magnetic switch disconnected in the present invention.
Figure 7:
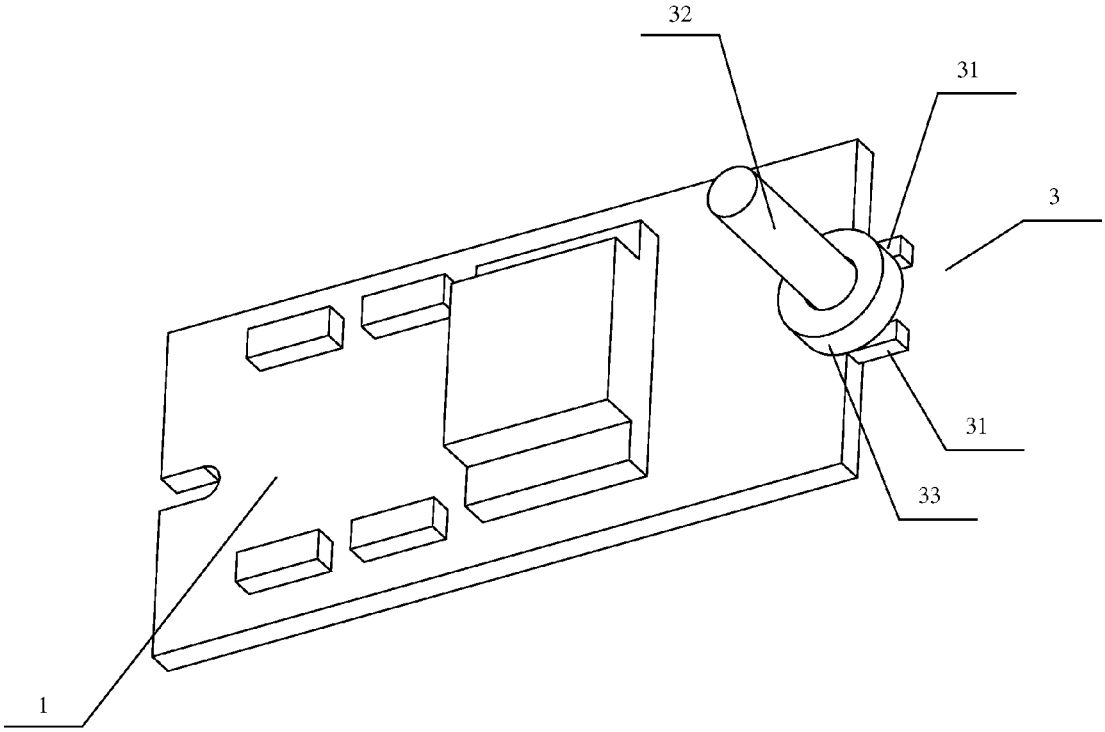
FIG. 7 is the diagram of connected chip magnetic switch during the assembly process in the present invention.
Figure 8:
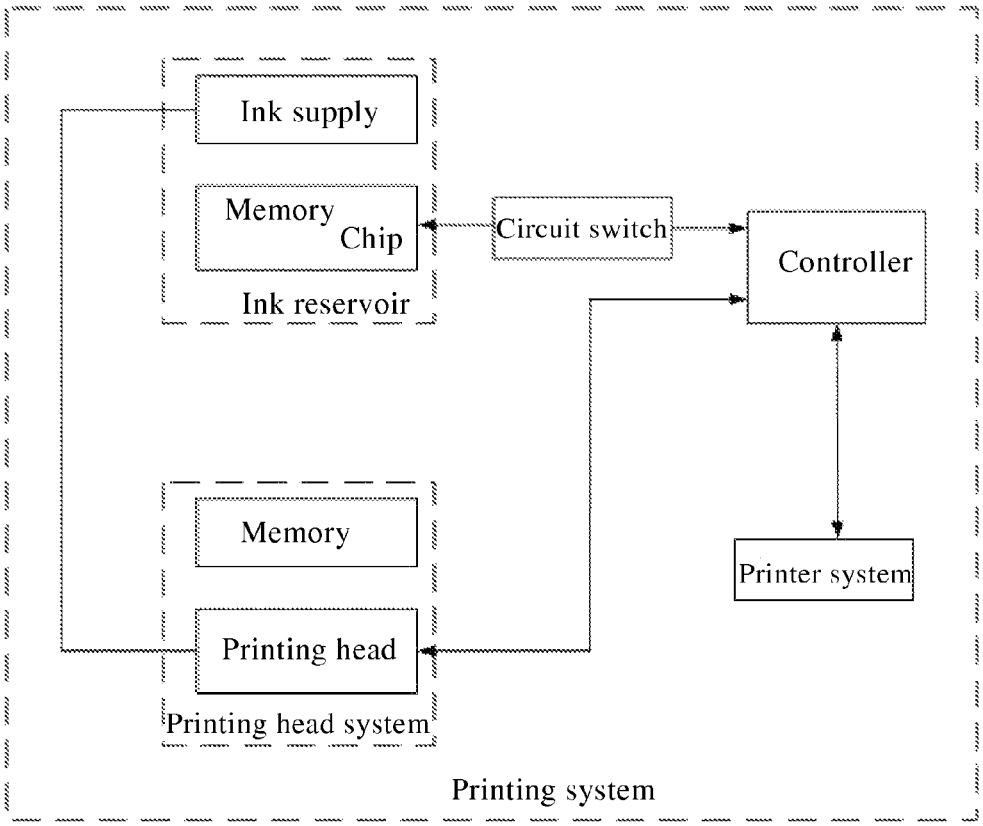
FIG. 8 is the modular circuit diagram of the printing system in the present invention.

FIG. 2 is the diagram of the printer adapter in the present invention. FIG. 3 is the diagram of the ink cartridge in the present invention. FIG. 4 is the conjunction structure diagram of the adapter and ink cartridge in the present invention. FIG. 5 is the shape diagram of the chip in the present invention. FIG. 6 is the diagram of the relative position between the ink cartridge and the chip during the assembly process with the magnetic switch disconnected in the present invention. FIG. 7 is the diagram of connected chip magnetic switch in the assembly process of the present invention. FIG. 8 is the modular circuit diagram of the printing system in the present invention.

As shown in FIG. 2~FIG. 7, an adapter 2 on jet printer, comprising an inner chamber to accommodate the ink cartridge 5 and a chip 1 set on the adapter 2, wherein the contact surface of chip 1 and the printer is set with an information contact that is electrically connected with the printer, two memories that detect the electrical contact and store the ink information. The said chip can be set on the surface of the side wall where the adapter and the printing head have their corresponding contacts jointed. In addition, the memory can be set in the enclosed space between the back of the circuit board and the adapter.

When the ink level information in the chip 1 reaches a certain value, the reset unit will make the ink level information reset automatically and the printer will prompt to change the ink cartridge 5. The non-contact trigger switch in the embodiment can be a magnetic switch. The said non-contact trigger switch can be set on the opposite back surface or the same surface of two detecting contacts of the said chip. Take out the ink cartridge 5 from the adapter 2. When the non-contact trigger mechanism 4 passes through the acting scope of the magnetic switch 3, the magnet 33 in the magnetic switch 3 is attracted by the non-contact trigger mechanism 4 to move along the stop stud 32 towards the non-contact trigger mechanism 4, leaving the original closed position. In this case, the internal circuit of the chip 1 is disconnected, as shown in FIG. 8. FIG. 8 is the modular circuit diagram of the printing system in the present invention. After the non-contact trigger mechanism 4 leaves the acting scope of the magnetic switch 3, the magnet is attracted by itself to move towards the contact 31 that is connected with the detecting contact till they contact. In this case, the magnetic switch 3 is closed. After installing a new ink cartridge 5, the trigger unit will disconnect the circuit of the chip 1 again in reverse steps. The printer reads the ink information on the chip 1 and prompts that the ink cartridge works normally. The contact 31 connected with the detecting contact is electrically connected with two detecting contacts respectively. The magnetic switch 3 is triggered by the non-contact trigger mechanism 4 on the ink cartridge 5 (as shown in FIG. 6) to become disconnected at least once when the ink cartridge 5 is inserted into the printer, after which it is not triggered by the non-contact trigger mechanism 4 so as to go to the connected status. The non-contact trigger switch is connected and disconnected by controlling the magnetic field force between the non-contact trigger switch and the non-contact trigger mechanism. The non-contact trigger switch is a normally closed magnetic switch, which has a metal that generates magnetic force with the non-contact trigger mechanism, for example magnet. Alternatively, the said non-contact trigger switch is a normally closed magnetic switch, which has an elastic component and ferromagnetic substance. The magnetic flux of the magnet 33 of the said non-contact trigger switch is 500~1500 gauss. The non-contact trigger mechanism 4 is a magnet or ferromagnetic substance that can generate magnetic force with the non-contact trigger switch. The magnetic flux of the magnet of the said non-contact trigger mechanism 4 is 1000~5000 gauss.

First, install the adapter 2 into the printer. In this case, the circuit of the chip 1 is connected and the printer reads the information in the chip 1. Then, after installing the ink cartridge 5 into the adapter 2, during the installation, when the non-contact trigger mechanism 4 (as shown in FIG. 6) on the side wall of the ink cartridge 5 passes through the acting scope of the magnetic switch 3 of the chip 1, the internal circuit of the chip 1 is disconnected. Then, continue installing the ink cartridge 5 to make it leave the acting scope of the magnetic switch 3 of the chip 1 till it is installed on the preset position and the circuit of the chip 1 is closed. In this case, the printer prompts that an ink cartridge 5 is available and reads the ink information. The printer prompts that the ink cartridge 5 installed just now works normally.

After the ink is run out, the chip 1 is reset automatically. The printer will prompt to change the ink cartridge 5. When taking out the ink cartridge 5 from the printer adapter 2, the trigger unit on the side wall of the ink cartridge 5 passes through the magnetic switch 3 of the chip 1 again. The internal circuit of the chip 1 is disconnected again. After the new ink cartridge 5 is installed, the ink cartridge 5 trigger unit connects and disconnects the internal circuit of the chip 1 again. In this case, the printer reads the reset ink information and continues working.

The said non-contact trigger mechanism is embedded in the ink cartridge of the side wall corresponding to the non-contact trigger switch of the adapter chip, the trigger travel path of the said non-contact trigger mechanism passes through the trigger area of the non-contact trigger switch. The said non-contact trigger mechanism is set on the side wall of the ink cartridge in a fixed manner, the trigger travel path of the said non-contact trigger mechanism passes through the trigger area of the non-contact trigger switch. The said non-contact trigger mechanism is set on the ink cartridge side wall in a movable manner and the trigger travel path of the said non-contact trigger mechanism passes through the trigger area of the non-contact trigger switch. The effective distance between the non-contact trigger mechanism and the non-contact trigger switch in the trigger area is 3~10 mm.

The present invention triggers the chip 1 switch to activate the chip 1 by using the trigger unit (namely non-contact trigger mechanism) on the side wall of ink cartridge 5, so as to make the printer read the ink information and detect the presence of the ink cartridge 5. As a result, the adapter 2 can be installed into the printer permanently and the user only needs to change the ink cartridge 5 without the chip 1.

Embodiment 2

Figure 9:
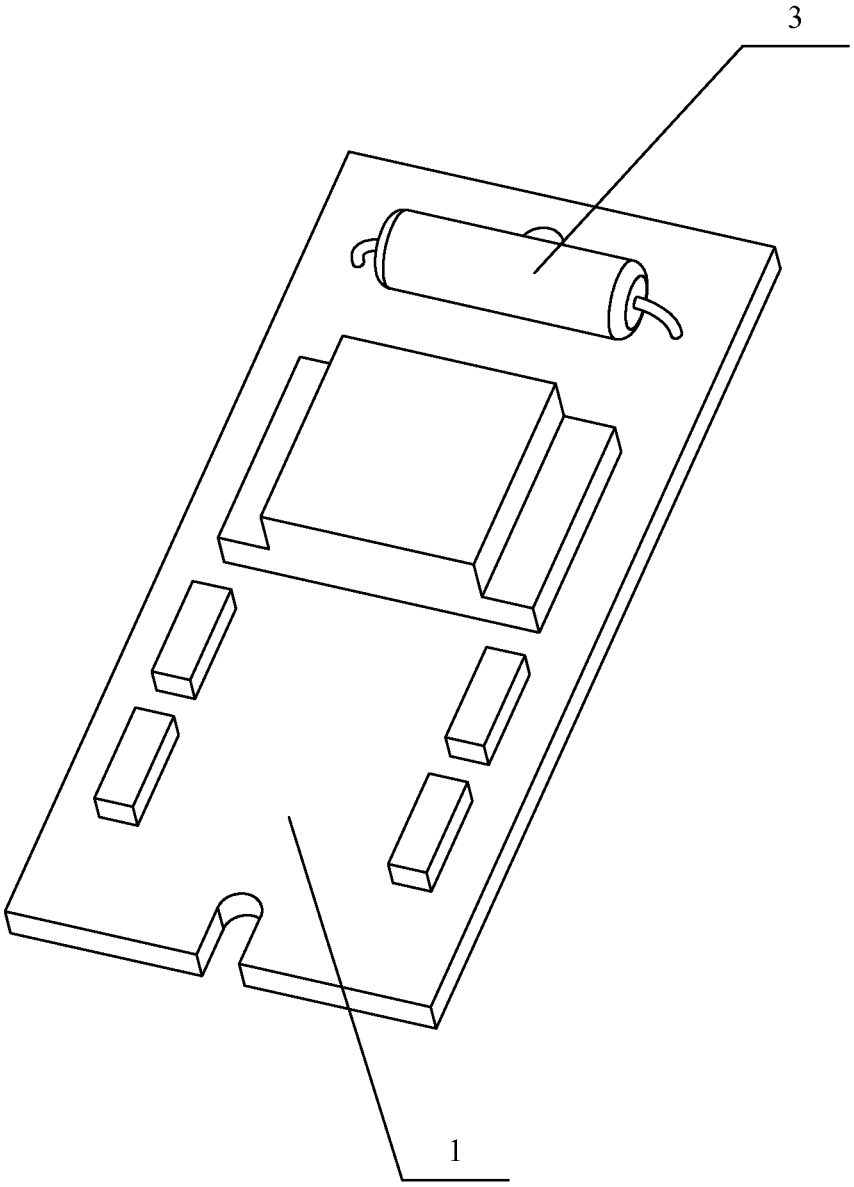
FIG. 9 is the structural diagram of the chip in the adapter on the jet printer in the present invention.

FIG. 9 is the structural diagram of the chip in the adapter on the jet printer in the present invention. As shown in FIG. 9, the main difference between the chip in the adapter of this embodiment and that in embodiment 1 lies in that the non-contact trigger switch on the chip 1 can be a reed switch.

The present invention also provides a cost effective and easy-to-use ink cartridge. The ink cartridge is set with a non-contact trigger mechanism that matches the non-contact trigger switch of the chip. The ink cartridge can be used together with the adapter in embodiment 1 or 2.

The said non-contact trigger mechanism is a magnet that can generate magnetic force with the non-contact trigger switch. The magnetic flux of the magnet on the said non-contact trigger mechanism is 1000~5000 gauss.

The said non-contact trigger mechanism is ferromagnetic substance that can generate magnetic force with the non-contact trigger switch. The said non-contact trigger mechanism is embedded in the ink cartridge of the side wall corresponding to the non-contact trigger switch of the adapter chip, the trigger travel path of the said non-contact trigger mechanism passes through the trigger area of the non-contact trigger switch. Alternatively, the said non-contact trigger mechanism is set on the side wall of the ink cartridge in a fixed manner, the trigger travel path of the said non-contact trigger mechanism passes through the trigger area of the non-contact trigger switch. Alternatively, the said non-contact trigger mechanism is set on the side wall of the ink cartridge in a movable manner, the trigger travel path of the said non-contact trigger mechanism passes through the trigger area of the non-contact trigger switch.

The effective distance between the non-contact trigger mechanism and the non-contact trigger switch in the trigger area is 3~10 mm. For the matching action process of the ink cartridge and the adapter in this embodiment, see embodiment 1.

The embodiment activates the chip 1 by setting the trigger chip switch of non-contact trigger mechanism on the side wall of ink cartridge, so as to make the printer read the ink information and detect the presence of the ink cartridge 5. As a result, the adapter 2 can be installed into the printer permanently and the user only needs to change the ink cartridge 5 without the chip 1.

It should be noted that the foresaid embodiments have been described to illustrate but not limit the technical solution of the present invention and all parameter values can be adjusted according to the specific conditions and fall into the scope of the claims. It should be understood by those skilled in the art that modification or equivalent substitution may be made therein without departing from the spirit and scope of the invention as defined by the appended claims.

What is claimed is:

1. An adapter on a jet printer, comprising an inner chamber for accommodating an ink cartridge and a chip set on the adapter, wherein a contact surface of said chip contacting with the printer is set with an information contact and two detecting electrical contacts, and the information contact and the two detecting electrical contacts are electrically connected with the printer, characterized in that a memory for storing an ink information is arranged on the chip, and said chip further is set with a non-contact trigger switch, and the non-contact trigger switch comprises two contacts and a magnet, wherein the two contacts of the non-contact trigger switch are connected with the two detecting electrical contacts respectively, and when a non-contact trigger mechanism on the ink cartridge passes through an acting scope of the non-contact trigger switch, the magnet is attracted by the non-contact trigger mechanism to move towards the non-contact trigger mechanism and to become disconnected with the two contacts of the non-contact trigger switch, and after the non-contact trigger mechanism leaves the acting scope of the non-contact trigger switch, the magnet moves towards the two contacts of the non-contact trigger switch till they connect with each other.

2. The adapter on the jet printer as recited in claim 1, characterized in that said chip is set on a surface of a side wall where the adapter and a printing head have their corresponding contacts jointed.

3. The adapter on the jet printer as recited in claim 1, characterized in that said memory is set in an enclosed space between a back of a circuit board and the adapter.

4. The adapter on the jet printer as recited in claim 1, characterized in that said non-contact trigger switch is set on the opposite back surface or the same surface of two detecting electrical contacts of said chip.

5. An ink cartridge corresponding to the adapter on the jet printer as recited in claim 1, characterized in that said ink cartridge is set with the non-contact trigger mechanism that matches the non-contact trigger switch of the chip.

6. The ink cartridge as recited in claim 5, characterized in that said non-contact trigger mechanism is a magnet that can generate a magnetic action with the non-contact trigger switch.

7. The ink cartridge as recited in claim 6, characterized in that a magnetic flux of the magnet of said non-contact trigger mechanism is 1000~5000 gauss.

8. The ink cartridge as recited in claim 5, characterized in that said non-contact trigger mechanism is a ferromagnetic substance that can generate a magnetic action with the non-contact trigger switch.

9. The ink cartridge as recited in claim 5, characterized in that said non-contact trigger mechanism is pre-embedded in the ink cartridge at a side wall corresponding to the non-contact trigger switch of the chip of the adapter, and a trigger travel path of said non-contact trigger mechanism passes through a trigger area of the non-contact trigger switch.

10. The ink cartridge as recited in claim 5, characterized in that said non-contact trigger mechanism is set on a side wall of the ink cartridge in a fixed manner, and a trigger travel path of said non-contact trigger mechanism passes through a trigger area of the non-contact trigger switch.

11. The ink cartridge as recited in claim 5, characterized in that said non-contact trigger mechanism is set on a side wall of the ink cartridge in a movable manner, and a trigger travel path of said non-contact trigger mechanism passes through a trigger area of the non-contact trigger switch.

12. The ink cartridge as recited in claim 9, characterized in that an effective action distance between the non-contact trigger mechanism and the non-contact trigger switch in the trigger area is 3~10 mm.

13. The ink cartridge as recited in claim 10, characterized in that an effective action distance between the non-contact trigger mechanism and the non-contact trigger switch in the trigger area is 3~10 mm.

14. The ink cartridge as recited in claim 11, characterized in that an effective action distance between the non-contact trigger mechanism and the non-contact trigger switch in the trigger area is 3~10 mm.

15. The adapter as recited in claim 1, characterized in that said non-contact trigger switch further comprises a stop stud, and the magnet has a ring shape and the stop stud passes through a center of the ring-shaped magnet.

16. The adapter as recited in claim 1, characterized in that the acting scope of the non-contact trigger switch is 3~10 mm.

* * * * *